US008304044B2

(12) United States Patent
Vreeland

(10) Patent No.: US 8,304,044 B2
(45) Date of Patent: Nov. 6, 2012

(54) DYE TRANSFERABLE MATERIAL WITH IMPROVED IMAGE STABILITY

(75) Inventor: William B. Vreeland, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 267 days.

(21) Appl. No.: 12/565,140

(22) Filed: Sep. 23, 2009

(65) Prior Publication Data

US 2011/0067804 A1 Mar. 24, 2011

(51) Int. Cl.
*B41M 5/40* (2006.01)

(52) U.S. Cl. ..... 428/32.6; 428/32.75; 156/230; 156/234; 503/227; 524/99

(58) Field of Classification Search ..... 503/227; 428/32.6, 32.75; 156/230, 234; 524/99
See application file for complete search history.

(56) References Cited

U.S. PATENT DOCUMENTS

| | | | | |
|---|---|---|---|---|
| 4,855,281 | A * | 8/1989 | Byers | 503/227 |
| 5,318,882 | A | 6/1994 | Ootaguro et al. | |
| 5,332,713 | A * | 7/1994 | Oldfield et al. | 503/227 |
| 5,457,000 | A * | 10/1995 | Defieuw et al. | 430/200 |
| 6,919,109 | B2 | 7/2005 | Nakano et al. | |
| 7,160,664 | B1 * | 1/2007 | Goswami et al. | 430/201 |
| 7,226,891 | B2 * | 6/2007 | Nakayama et al. | 503/227 |
| 7,301,012 | B2 | 11/2007 | Fujiwara | |
| 7,384,138 | B2 | 6/2008 | Taguchi | |
| 2004/0131958 | A1 | 7/2004 | Feng et al. | |

FOREIGN PATENT DOCUMENTS

| | | |
|---|---|---|
| JP | 03-112685 | 5/1991 |
| WO | WO 2007069504 A1 * | 6/2007 |

OTHER PUBLICATIONS

Goldstein et al. J. Am. Chem. Soc., 2003, (125), 789-795.*
Abstract—JP 03-112685, published May 14, 1991 (Fuji Photo Film Co. Ltd).
U.S. Appl. No. 12/565,112, filed Sep. 23, 2009, titled "Heat Transferable Material for Imprioved Image Stability" by W. B. Vreeland.

* cited by examiner

*Primary Examiner* — Ling Choi
*Assistant Examiner* — Wenwen Cai
(74) *Attorney, Agent, or Firm* — J. Lanny Tucker

(57) ABSTRACT

A heat transferable dye donor element includes a heat transferable dye and an N-oxyl radical light stabilizer that is derived from a hindered amine. The N-oxyl radical has the following formula,

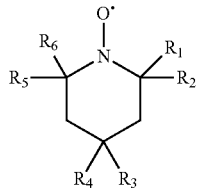

wherein $R_1$, $R_2$, $R_5$, and $R_6$ are each independently selected from a straight or branched $C_1$-$C_6$ alkyl, and $R_3$ and $R_4$ are each independently selected from H, OH, OR, COOH, or COOR, wherein R is a straight or branched $C_1$-$C_6$ alkyl or alkene, and has a molecular weight of 600 or less. The dye donor element includes a heat transferable material that can be in one or more sections or patches including heat transferable dye patches. The heat transferable material provides better dye image stability when applied to a thermal receiver element.

9 Claims, No Drawings

DYE TRANSFERABLE MATERIAL WITH IMPROVED IMAGE STABILITY

FIELD OF THE INVENTION

The present invention relates to a heat transferable dye donor element including an N-oxyl radical that is derived from a hindered amine and that provides improved dye image stability when applied to a dye receiver element.

BACKGROUND OF THE INVENTION

There are many ways of forming an image. Images can be formed through thermal transfer of dyes, inkjet applications, electrophotographic reproduction, and silver halide image development. Also known is that all such images are susceptible to environmental factors, particularly light fade.

To form any printed image, the image is either chemically developed from film, or developed from an electronic signal generated from either a digital capture device, or scanning of a film. For thermal, inkjet, and electrophotographic prints, electronic signals indicating appropriate colors are used to produce cyan, magenta and yellow color signals. These signals are then transmitted to a printer where colored material is transferred to a receiver element. A color hard copy is thus obtained that corresponds to the original image.

Thermal, ink jet, and electrophotographic prints are susceptible to retransfer of colorants to adjacent surfaces and to discoloration by fingerprints because the colorants remain at the surface of the receiver element. Heat can be used to drive the colorants deeper into the receiver element. Application of a protective overcoat on these types of prints, as well as silver halide prints, is also known, and effectively reduces retransfer and discoloration by adding a protective polymeric layer over the image. The protective overcoat can also provide improved light stability if a UV absorbing compound is incorporated in the formulation.

Improved image stability can also be achieved by incorporating light stabilizers in close proximity to the colorants within the receiver element. Light stabilizers can be added to the receiver element during manufacture by aqueous or solvent coating or thermal extrusion of materials incorporating the light stabilizers. If thermal extrusion is used, only light stabilizers with very high thermal stabilities can be used due to the temperatures of extrusion, typically 250° C. or higher. The light stabilizers must be incorporated within the receiver element in such a manner that they will react with the colorants when applied to the receiver element.

For example, various stabilizers are described in U.S. Pat. No. 4,855,281 (Byers) for use in thermal dye donor elements. Specifically, nickel complexes are described for this purpose but these compounds are not desirable because of harm they can cause to the environment. In addition, a variety of alkoxy-substituted aromatic stabilizers are described but they do not provide adequate light stability with all dyes that may be useful in thermal dye donor elements.

U.S. Pat. No. 7,301,012 (Fujiwara) and U.S. Pat. No. 7,384,138 (Taguchi) disclose the use of hindered amine light stabilizers (HALS) in receiver elements to provide image dye stability.

There remains a need for a heat transferable dye donor element that provides greater dye image stability in the transferred dye image, and especially for transferred cyan dye images.

SUMMARY OF THE INVENTION

The present invention relates to a heat transferable dye donor element comprising a polymeric support, the support having at least one portion thereof coated with a heat transferable material comprising a heat transferable dye and an N-oxyl radical as a light stabilizer, which N-oxyl radical has the following formula:

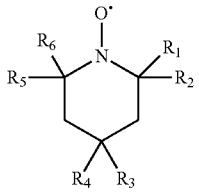

wherein $R_1$, $R_2$, $R_5$, and $R_6$ are each independently selected from a straight or branched $C_1$-$C_6$ alkyl or alkene, and $R_3$ and $R_4$ are each independently selected from H, OH, OR, COOH, or COOR, wherein R is a straight or branched $C_1$-$C_6$ alkyl or alkene, and having a molecular weight of 600 or less.

This invention also provides an assemblage for transferring one or more dyes imagewise to a dye image-receiver element from the heat transferable dye donor element of this invention. The heat transferable material can be in one or more dye donor patches in the heat transferable dye donor element.

The heat transferable material used in this invention contains an N-oxyl radical derived from a hindered amine as a light stabilizer that provides the advantages of reducing light fade of transferred dye images and lowering costs for image production by reducing or eliminating the need for UV absorbing materials. These advantages are particularly true for transferred cyan dye images. Other advantages will be apparent upon review of this document in full.

DETAILED DESCRIPTION OF THE INVENTION

The invention relates to a heat transferable dye donor elements containing a heat transferable material that is useful to provide dye images in dye receiver elements for thermal printing. The heat transferable material is present on at least a portion of a dye donor element, wherein the dye donor element has a support and disposed on one side of the support, a light stabilizer having a molecular weight of at least 140 and less than 600, and optionally a non-heat transferable polymeric binder. Generally, the light stabilizer is an N-oxyl radical derived from a hindered amine and having the following formula:

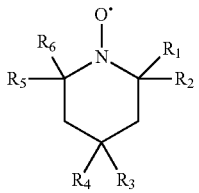

wherein $R_1$, $R_2$, $R_5$, and $R_6$ are each independently selected from a straight or branched $C_1$-$C_6$ alkyl or alkene, and $R_3$ and $R_4$ are each independently selected from H, OH, OR, COOH, or COOR, wherein R is a straight or branched C1-C6 alkyl or alkene.

According to various embodiments, $R_3$ and $R_4$ can each separately be chosen from $CH_2CH_3$, $CH_3$, or H. For example, $R_3$ and $R_4$ can be both hydrogen. According to various embodiments, $R_1$, $R_2$, $R_5$, and $R_6$ can each independently be chosen from $CH_2CH_3$, $CH_3$, or H. Also, $R_1$, $R_2$, $R_5$, and $R_6$ can each independently be chosen from $CH_3$ or H, and typically each is $CH_3$. A useful light stabilizer is available commercially as TEMPO from Evonik/Degussa.

It is noted that the light stabilizer is an oxyl radical, and is a singlet oxygen quencher. It is present in an active form and is not consumed by the continual generation of free radicals unlike other known stabilizers that are quenched in the presence of free radicals. When present in a heat transferable material on a dye donor element, the light stabilizer transfers like a colorless dye from the dye donor element or to a dye receiver element upon printing. That is, the light stabilizer migrates upon heating from the heat transferable material to a dye receiver element. For this reason, a light stabilizer with a low molecular weight, such as 600 or less, is desired so that it can more easily transfer between the dye donor element and dye receiver element. Similarly, side chains for $R_1$-$R_6$ with less steric hindrance are useful to enable migration. In some literature, the N-oxyl radical described herein is known as a "hindered amine light stabilizer" or "HALS" compound.

It appears that the N-oxyl radical light stabilizer reacts to the presence of a plasticizer and bind thereto. The presence of a plasticizer in the dye image-receiver element to which the light stabilizer is being transferred may be desirable in many embodiments as it appears the plasticizer will bind the light stabilizer and prevent any retransfer or further migration into the other dye image-receiver element layers. This behavior many enhance the dye image stability in the dye image-receiver element in some cases, for example, the stability of cyan dye images. Useful amounts and types of plasticizer are described below. However, the presence of a plasticizer in the heat transferable material including the N-oxyl radical light stabilizer can hamper transfer of the light stabilizer to the dye image-receiver element, and instead mordanting the light stabilizer in the patch on the dye donor element. It is desirable to have little or no plasticizer present in the heat transferable material including the light stabilizer, for example, an amount of plasticizer of 5% or less by weight of the heat transferable material, typically 3% or less by weight, more typically 0 to 2% or less by weight, but in some embodiments, the amount is at least 4 weight % based on total polymer weight in the dye image-receiving layer.

Any material can be used as the support for the heat transferable dye donor element of the invention provided it is dimensionally stable and can withstand the heat of thermal transfer, for example from a thermal printing head. Suitable materials can include, for example, polyesters such as poly (ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support can have a thickness of from about 2 to about 30 μm, although thicker or thinner supports could be used for specific applications. According to certain embodiments where a high gloss image is desired, the support can have a surface roughness, Ra, of about 18 nm or less on the side of the support on which the heat transferable material is provided.

The heat transferable material can be provided in one or more sections, or patches, on the dye donor element, or the heat transferable material can coat the entire length of the dye donor element. The dye donor element can be provided as sheets or rolls of any desired width and length suitable for the intended thermal transfer apparatus. The patches on a dye donor element can be the same or different, and can be in a repeating pattern if desired. Typical dye patch colors include yellow, cyan, and magenta, although black, white, metallics, and secondary and tertiary colors can be also provided in a dye patch. A dye donor element can include one of each of two or more desired colored dye patches followed by a protective overcoat patch, or a single color dye patch followed by a protective overcoat patch. The sequence can repeat, if desired. An exemplary sequence commonly used in thermal dye diffusion printing is a repeat of yellow, magenta, cyan, and protective overcoat patches.

The heat transferable dye donor element of the present invention can include one or more non-heat transferable polymeric binders in the heat transferable material. Such polymeric binders are known for use in dye diffusion thermal transfer media. Heat transferable polymeric binders are generally not present in the heat transferable material since it is desired that essentially only the dye(s) and N-oxyl radical compounds are transferred.

The heat transferable material in the dye donor layer includes an N-oxyl radical light stabilizer, for example of the following Formula III, known as TEMPO:

III

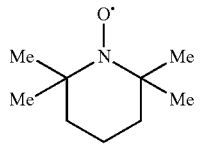

In one embodiment of the invention, the heat transferable dye donor element is a multicolor element comprising repeating color patches of yellow, magenta and cyan image dyes, respectively, dispersed in a binder, and a patch containing the protection layer. In another embodiment of the invention, a color patch is the only layer on the dye donor element and is used in conjunction with another dye donor element that contains the same or different image dyes. Alternatively, the heat transferable dye donor element can include protective overcoat patches, or be used in combination with separate donor elements containing a protective overcoat layer such as that described in copending and commonly assigned U.S. Ser. No. 12/565,112 (filed by me on Sep. 23, 2009) as a CIP of U.S. Ser. No. 12/436,833 (filed on May 7, 2009) that is based on Provisional application 61/156,605 (filed on Mar. 2, 2009). Such protective overcoat layers include one or more N-oxyl radical compounds and one or more heat transferable polymeric binders. The N-oxyl radical compounds in the protective overcoat layer can be the same or different as the N-oxyl radical compounds used in the heat transferable dye donor elements of the present invention.

The useful amounts of N-oxyl radical light stabilizer in the heat transferable materials used in this invention are at least 1.08 $mg/m^2$ and up to and including 32.4 $mg/m^2$. Some embodiments include one or more N-oxyl radical compounds at from about 5.4 to about 27 $mg/m^2$. The amount can be the same or different in various dye patches. For example, it may be higher in the cyan dye patches than other dye patches. The light stabilizer content in the dye patches may also be the same or different as the light stabilizer content in protective overcoat layers. For example, the amount of light stabilizer in a cyan dye patch or donor layer may be up to twice as much as that in a protective overcoat layer.

In some embodiments, the dye donor layer may also contain crosslinked elastomeric organic beads. The beads can have a glass transition temperature (Tg) of 45° C. or less, for example, 10° C. or less. The elastomeric beads can be made from an acrylic polymer or copolymer, such as butyl-, ethyl-, propyl-, hexyl-, 2-ethylhexyl-, 2-chloroethyl-, 4-chlorobutyl- or 2-ethoxyethyl-acrylate or methacrylate; acrylic acid; methacrylic acid; hydroxyethyl acrylate; a styrenic copolymer, such as styrene-butadiene, styrene-acrylonitrile-butadiene, styrene-isoprene, or hydrogenated styrene-butadiene; or mixtures thereof. The elastomeric beads can be crosslinked with various crosslinking agents, which can be part of the elastomeric copolymer, such as but not limited to divinylbenzene; ethylene glycol diacrylate; 1,4-cyclohexylene-bis(oxyethyl)dimethacrylate; 1,4-cyclohexylene-bis(oxypropyl)diacrylate; 1,4-cyclohexylene-bis(oxypropyl)dimethacrylate; and ethylene glycol dimethacrylate. The elastomeric beads can have from about 1 to about 40%, for example, from about 5 to about 40%, by weight of a crosslinking agent. The elastomeric microbeads may be employed in any amount effective for the intended purpose. In general, good results have been obtained at a coverage of from about 2 to about 25 $mg/m^2$. The elastomeric microbeads generally have a particle size of from about 4 μm to about 10 μm. At these levels, the beads are not detrimental to gloss, and are beneficial for finishing operations involving web-transport and spool winding.

The elastomeric beads may be crosslinked with various crosslinking agents, which may also be part of the elastomeric copolymer, such as divinylbenzene; ethylene glycol diacrylate; 1,4-cyclohexylene-bis(oxyethyl) dimethacrylate; 1,4-cyclohexylene-bis(oxypropyl)diacrylate; 1,4-cyclohexylene-bis(oxypropyl)dimethacrylate; and ethylene glycol diacrylate.

The glass transition temperatures were determined by the method of differential scanning calorimetry (DSC) at a scanning rate of 20° C./minute and the onset in the change in heat capacity was taken as the Tg.

Following are examples of typical elastomeric microbeads that may be employed in the invention:

Bead 1) poly(butyl acrylate-co-divinylbenzene) (80:20 mole ratio) having a nominal diameter of approximately 4 μm and a Tg of approximately −31° C.

Bead 2) poly(styrene-co-butyl acrylate-co-divinylbenzene) (40:40:20 mole ratio) having a nominal diameter of approximately 4 μm and a Tg of approximately 45° C.

Bead 3) poly(ethyl acrylate-co-ethylene glycol diacrylate) (90:10 mole ratio) having a nominal diameter of approximately 5 μm and a Tg of approximately −22° C.

Bead 4) poly(2-ethylhexyl acrylate-co-styrene-co-divinylbenzene) (45:40:15 mole ratio) having a nominal diameter of approximately 5 μm and a Tg of approximately 20° C.

Bead 5) poly[2-chloroethylacrylate-co-1,4-cyclohexylene-bis(oxypropyl)diacrylate] (80:20 mole ratio) having a nominal diameter of approximately 7 μm and a Tg of approximately −10° C.

Bead 6) poly(butyl methacrylate-co-hydroxyethyl-acrylate-co-divinylbenzene) (65:10:25 mole ratio) having a nominal diameter of approximately 6 μm and a Tg of approximately 29° C.

Bead 7) poly(styrene-co-butadiene-co-divinylbenzene) (40:50:10 mole ratio) having a nominal diameter of approximately 8 μm and a Tg of approximately −55° C.

Bead 8) poly(styrene-co-2-ethyoxyethyl acrylate-co-ethylene glycol diacrylate) (20:45:35 mole ratio) having a nominal diameter of approximately 4 μm and a Tg of approximately −5° C.

Bead 9) poly(styrene-co-hexyl acrylate-co-divinylbenzene) (10:70:20 mole ratio) having a nominal diameter of approximately 4 μm and a Tg of approximately −15° C.

The dye donor formulation is coated onto a support sheet, for example, by gravure printing, screen printing, or reverse coating using a gravure plate, and drying the coating.

In general use, yellow, magenta, and cyan dyes are thermally transferred from a heat transferable dye donor element to form an image on a dye receiving element or sheet. The thermal head can be used to transfer the dye from a dye patch on the dye donor element onto a receiver element by varying the amount of heat applied according to the image being printed. The transferred dye adheres to the print and is released from the donor element support in the areas where heat is applied. After a suitable number of dye images are transferred (for example, a combination of cyan, yellow, and magenta dye images), an overcoat protective layer can then transferred onto the top of the final dye image.

The heat transferable dye donor element of the present invention may be used in sheet form or in a continuous roll or ribbon. If a continuous roll or ribbon is employed, it may have only one dye or may have alternating areas of other different dyes, such as diffusible or sublimable cyan, magenta, yellow, black, or other dyes.

Any dye can be used in the dye donor layer of the dye donor element of the invention provided it is transferable to a dye receiving layer by the action of heat. Especially good results have been obtained with diffusible dyes. Useful dyes, for example, are disclosed in U.S. Pat. Nos. 4,541,830; 4,698,651; 4,695,287; 4,701,439; 4,757,046; 4,743,582; 4,769,360; and 4,753,922, the disclosures of which are hereby incorporated by reference. Thus, one-, two-, three- or four-color dye donor elements (or higher numbers also) are included within the scope of the invention. The dyes can be selected by taking into consideration hue, lightfastness, and solubility of the dyes in the dye donor layer binder and the dye image receiving layer binder.

In some embodiments of the invention, the dye donor element comprises a poly(ethylene terephthalate) support coated with sequential repeating areas of yellow, cyan and magenta dye, and a protective overcoat layer. The process steps are sequentially performed for each color to obtain a three-color dye transfer image with an overcoat protective layer on top. When the process is only performed for a single color, a monochrome dye transfer image is obtained.

One or more heat transferable N-oxyl radical light stabilizers are present in one or more of the dye donor dye formulations. As such, these dye formulations may be also used in combination with a protective overcoat containing one or more of the same or different heat transferable light stabilizers.

In still other embodiments of the invention, the dye donor element is a monochrome element and comprises repeating units of two areas, the first area comprising a layer of one image dye dispersed in a polymeric binder, and the second area comprising an overcoat protective layer.

In yet other embodiments of the invention, the dye donor element is a black-and-white element and comprises repeating units of two areas, the first area comprising a layer of a mixture of image dyes dispersed in a non-heat transferable polymeric binder to produce a neutral color and the second area comprising an overcoat protective layer.

Some embodiments for magenta dye donors comprise a magenta dye, alone or in combination, such as at least a magenta dye of the following Structure I:

(I)

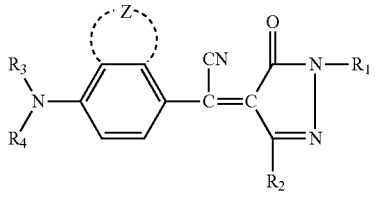

wherein:

$R_1$ represents an alkyl group having from 1 to 10 carbon atoms, a cycloalkyl group having from 5 to 7 carbon atoms, or an aryl group having from 6 to 10 carbon atoms;

$R_2$ represents an alkoxy group having from 1 to 10 carbon atoms, an aryloxy group having from 6 to 10 carbon atoms, naphthoxy, $NHR_5$, $NR_5$, or $R_6$;

$R_3$ and $R_4$ are each independently $R_1$, or either or both of $R_3$ and $R_4$ can be joined to the carbon atom of the aromatic ring at a position ortho to the position of attachment of the anilino nitrogen to form a 5- or 6-membered ring, or $R_3$ and $R_4$ can be joined together to form a 5- or 6-membered heterocyclic ring with the nitrogen to which they are attached;

$R_5$ and $R_6$ each independently represents an alkyl group having from 1 to 10 carbon atoms, a cycloalkyl group having from 5 to 7 carbon atoms, or an aryl group having from 6 to 10 carbon atoms, or $R_5$ and $R_6$ may be joined together to form, along with the nitrogen to which they are attached, a 5- or 6-membered heterocyclic ring; and Z represents hydrogen or the atoms necessary to complete a 5- or 6-membered ring. Additional magenta dyes can be added to the composition.

According to certain embodiments, in Structure I, $R_1$ can be phenyl or methyl; $R_3$ and $R_4$ can each independently be selected from methyl or ethyl; and $R_2$ can be $NR_5R_6$, wherein each of $R_5$ and $R_6$ is independently selected from methyl or ethyl. According to some embodiments, the magenta dyes can be represented by Structure Ia as follows:

(Ia)

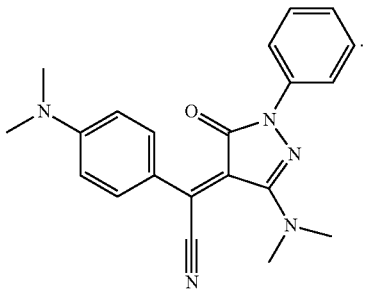

Other useful magenta dyes are represented by the following Structure II:

(II)

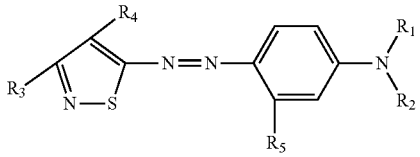

wherein $R_1$ and $R_2$ are each independently hydrogen, $C_{1-6}$ alkyl or allyl, $C_{5-7}$ cycloalkyl, $C_{5-10}$ aryl, or $R_1$ and $R_2$ can be taken together to form a 5- or 6-membered heterocyclic ring which can include the nitrogen to which $R_1$ or $R_2$ is attached, and either carbon atom ortho to the carbon attached to the nitrogen atom;

$R_3$ is a hydrogen, $C_{1-6}$ alkyl, $C_{5-10}$ aryl, alkylthio, or halogen;

$R_4$ is cyano, thiocyanato, alkylthio, or alkoxycarbonyl; and $R_5$ is a $C_{1-6}$ alkyl, a $C_{5-10}$ aryl, or NHA, where A is an acyl or sulfonyl radical. Exemplary dyes of Structure II include but are not limited to those represented by the following Structure IIa or IIb:

(IIa)

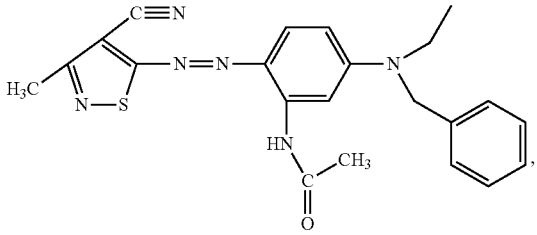

(IIb)

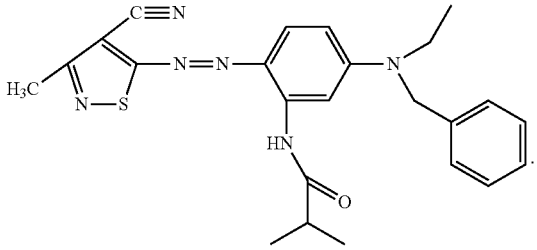

Additional magenta dyes as known in the art can be added to magenta dye combinations that include at least one magenta dye of each of Structures I and II. For example, the dyes of the following Structures III, IIIa, and IIIb are useful and are described in the art, for example in U.S. Pat. Nos. 5,476,943 and 5,532,202 that are incorporated herein by reference. Other known magenta dyes include MS Red G (Disperse Red 60, manufactured by Mitsui Toatsu Chemicals, Inc.), and dyes of the following Structures (IV) and (IVa).

A magenta dye combination can include a combination of dyes from each or both of Structures III and IIIa.

(III)

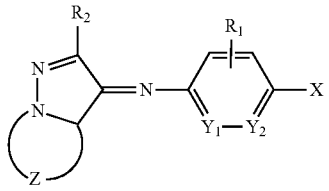

wherein X represents a $NR_3R_4$ group or a hydroxyl group, wherein $R_3$ and $R_4$ may be same or different and are independently selected from an alkyl, alkenyl, aryl, aralkyl, or cycloalkyl group; $Y_1$ and $Y_2$ each independently are selected from a carbon atom or a nitrogen atom, provided that one of $Y_1$ and $Y_2$ is a nitrogen atom; Z represents an atomic group necessary to form a 5- or 6-membered nitrogen-containing heterocyclic ring which may be condensed with another ring; and $R_1$ and $R_2$ are each independently selected from a hydrogen atom, halogen atom, alkyl, alkenyl, alkoxy, alkylamino, acetamido, sulfonamide, aryl, aralkyl, or cycloalkyl group. According to certain embodiments, Structure III, $Y_1$ can be a carbon atom, $Y_2$ can be a nitrogen atom, X can be an $NR_3R_4$ group wherein $R_3$ and $R_4$ may be same or different alkyl, Z can be a 5-membered nitrogen-containing heterocyclic ring, $R_1$ can be a hydrogen or alkyl group, and $R_2$ can be an alkyl group.

(IIIa)

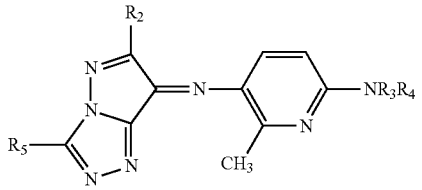

wherein $R_3$ and $R_4$ can be the same or different and are independently selected from an alkyl and an alkenyl; $R_2$ can be a $C_{1-6}$ alkyl; and $R_5$ can be a $C_{1-10}$ alkyl group, a $C_{5-7}$ cycloalkyl group, or a $C_{6-10}$ aryl group.

According to other embodiments, a magenta dye of Structure III can be as follows:

(IIIb)

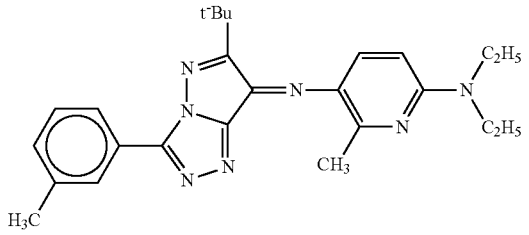

(IV)

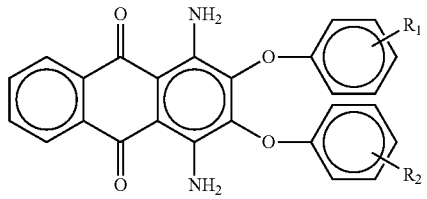

wherein $R_1$ and $R_2$ are each independently selected from hydrogen, hydroxyl, halogen, $C_{1-4}$ alkyl, or $C_{1-4}$ alkoxy. According to certain embodiments, $R_1$ and $R_2$ can be hydrogen, producing the dye of the following Structure IVa:

(IVa)

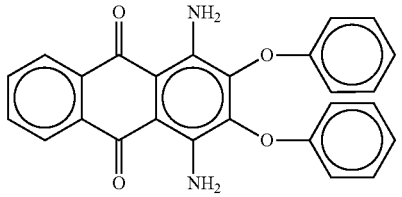

One or more dyes of and of the foregoing Structures, such as a combination of dyes from Structures I and II can be included in a total amount of from about 10 to about 90% by weight of the dye donor composition, for example, from about 10 to about 85% by weight, or from about 25 to about 75% by weight.

The dye donor layer can include a magenta dye combination alone, or multiple colored areas (patches) containing dyes suitable for thermal printing. As used herein, a "dye" can be one or more dyes, pigments, colorants, or a combination thereof, and can be in a non-heat transferable binder or carrier as known in the art. For example, the dye donor layer can include a magenta dye donor patch as well as a yellow dye donor patch comprising at least one bis-pyrazolone-methine dye and at least one other pyrazolone-methine dye, and a cyan dye donor patch comprising at least one indoaniline cyan dye Examples of sublimable or diffusible dyes include anthraquinone dyes, e.g., Sumikalon Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumickaron Diazo Black 5G® (Sumitomo Chemical Co., Ltd.), and Miktazol Black 5 GH® (Mitsui Toatsu Chemicals, Inc.); direct dyes such as Direct Dark Green B® (Mitsubishi Chemical Industries, Ltd.), Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumicacryl Blue 6G® (Sumitomo Chemical Co., Ltd.), and Aizen Malachite Green® (Hodogaya Chemical Co., Ltd.); or any of the dyes disclosed in U.S. Pat. No. 4,541,830, the disclosure of which is hereby incorporated by reference. The dyes may be employed singly or in combination to obtain a monochrome. The dyes may be used at a coverage of from about 0.05 to about 1 g/m$^2$ and are can be hydrophobic.

Examples of further suitable dyes, including further magenta, yellow, and cyan dyes, can include, but are not limited to, diarylmethane dyes; triarylmethane dyes; thiazole dyes, such as 5-arylisothiazole azo dyes; methine dyes such as merocyanine dyes, for example, aminopyrazolone merocyanine dyes; azomethine dyes such as indoaniline, acetophenoneazomethine, pyrazoloazomethine, imidazoleazomethine, imidazoazomethine, pyridoneazomethine, and tricyanopropene azomethine dyes; xanthene dyes; oxazine dyes; cyanomethylene dyes such as dicyanostyrene and tricyanostyrene dyes; thiazine dyes; azine dyes; acridine dyes; azo dyes such as benzeneazo, pyridoneazo, thiopheneazo, isothiazoleazo, pyrroleazo, pyrraleazo, imidazoleazo, thiadiazoleazo, triazoleazo, and disazo dyes; arylidene dyes such as alpha-cyano arylidene pyrazolone and aminopyrazolone arylidene dyes; spiropyran dyes; indolinospiropyran dyes; fluoran dyes; rhodaminelactam dyes; naphthoquinone dyes, such as 2-carbamoyl-4-[N-(p-substituted aminoaryl)imino]-1,4-naphthaquinone; anthraquinone dyes; and quinophthalone dyes. Specific examples of dyes usable herein can include but are not limited to:

C.I. (color index) Disperse Yellow 51, 3, 54, 79, 60, 23, 7, and 141;

C.I. Disperse Blue 24, 56, 14, 301, 334, 165, 19, 72, 87, 287, 154, 26, and 354;

C.I. Disperse Red 135, 146, 59, 1, 73, 60, and 167;

C.I. Disperse Orange 149;

C.I. Disperse Violet 4, 13, 36, 56, and 31;

C.I. Disperse Yellow 56, 14, 16, 29, and 231;

C.I. Solvent Blue 70, 35, 36, 50, 49, 111, 105, 97, and 11;

C.I. Solvent Red 135, 81, 18, 25, 19, 23, 24, 143, 146, and 182;

C.I. Solvent Violet 13;

C.I. Solvent Black 3; and

C.I. Solvent Green 3.

Other useful embodiments utilize a cyan dye, alone or in combination, comprising at least a first cyan dye of the following Structure XX:

(XX)

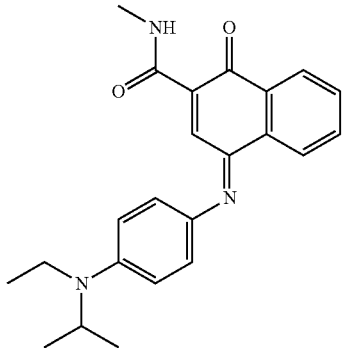

Other suitable cyan dyes can include Kayaset Blue 714 (Solvent Blue 63, manufactured by Nippon Kayaku Co., Ltd.), Phorone Brilliant Blue S—R (Disperse Blue 354, manufactured by Sandoz K.K.), and cyan dyes of the following structures:

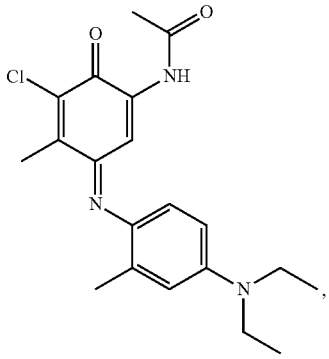

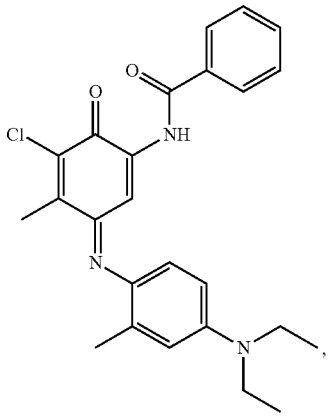

-continued

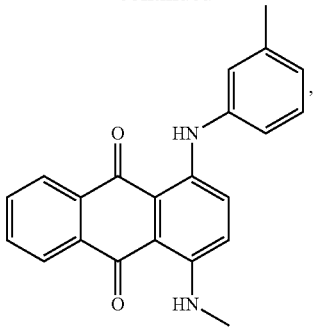

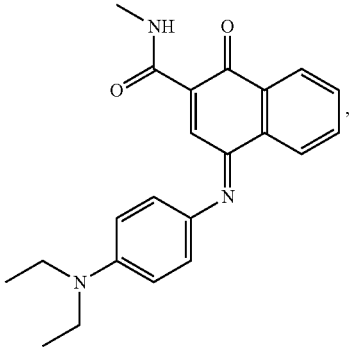

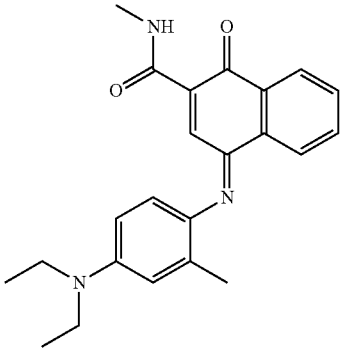

and

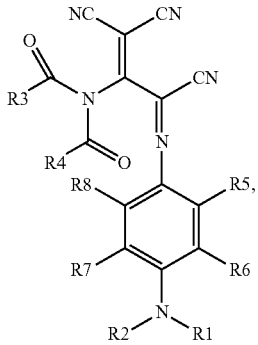

wherein R1 and R2 each independently represents an alkyl group, a cycloalkyl group, an aryl group, a heterocyclic group, or R1 and R2 together represent the necessary atoms to close a heterocyclic ring, or R1 and R2 together with R6 and R7 represent the necessary atoms to close a heterocyclic ring fused on the benzene ring; R3 and R4 each independently represents an alkyl group, or an alkoxy group; R5, R6, R7 and R8 each independently represents hydrogen, an alkyl group, a cycloalkyl group, an aryl group, an alkoxy group, an aryloxy group, a carbonamido group, a sulfamido group, hydroxy, halogen, $NHSO_2R_9$, $NHCOR_9$, $OSO_2R_9$, or $OCOR_9$, or R5 and R6 together and R7 and R8 together represent the necessary atoms to close one or more heterocyclic ring fused on the benzene ring, or R6 and R7 together with R1 and R2 represent the necessary atoms to close a heterocyclic ring fused on the benzene ring; and $R_9$ represents an alkyl group, a cycloalkyl group, an aryl group and a heterocyclic group.

Additional useful cyan dyes are represented by

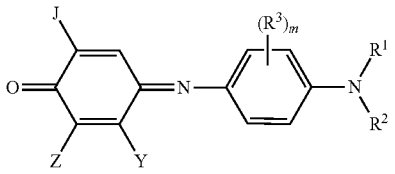

wherein: $R^1$ and $R^2$ each independently represents hydrogen; an alkyl group having from 1 to about 6 carbon atoms; a cycloalkyl group having from about 5 to about 7 carbon atoms; allyl; or such alkyl, cycloalkyl or allyl groups substituted with one or more groups such as alkyl, aryl, alkoxy, aryloxy, amino, halogen, nitro, cyano, thiocyano, hydroxy, acyloxy, acyl, alkoxycarbonyl, aminocarbonyl, alkoxycarbonyloxy, carbamoyloxy, acylamido, ureido, imido, alkylsulfonyl, arylsulfonyl, alkylsulfonamido, arylsulfonamido, alkylthio, arylthio, and trifluoromethyl, for example methyl, ethyl, propyl, isopropyl, butyl, pentyl, hexyl, methoxyethyl, benzyl, 2-methanesulfonamidoethyl, 2-hydroxyethyl, 2-cyanoethyl, methoxycarbonylmethyl, cyclohexyl, cyclopentyl, phenyl, pyridyl, naphthyl, thienyl, pyrazolyl, p-tolyl, p-chlorophenyl, m-(N-methyl-sulfamoyl)phenylmethyl, methylthio, butylthio, benzylthio, methanesulfonyl, pentanesulfonyl, methoxy, ethoxy, 2-methane-sulfonamidoethyl, 2-hydroxyethyl, 2-cyanoethyl, methoxy-carbonyl-methyl, imidazolyl, naphthyloxy, furyl, p-tolylsulfonyl, p-chlorophenylthio, m-(N-methyl sulfamoyl)phenoxy, ethoxycarbonyl, methoxyethoxycarbonyl, phenoxycarbonyl, acetyl, benzoyl, N,N-dimethylcarbamoyl, dimethylamino, morpholino, anilino, pyrrolidino etc.; each $R^3$ independently represents hydrogen, substituted or unsubstituted alkyl, cycloalkyl or allyl for $R^1$ and $R^2$; alkoxy, aryloxy, halogen, thiocyano, acylamido, ureido, alkylsulfonamido, arylsulfonamido, alkylthio, arylthio or trifluoromethyl; or any two of $R^3$ may be combined together to form a 5- or 6-membered carbocyclic or heterocyclic ring; or one or two of $R^3$ may be combined with either or both of $R^1$ and $R^2$ to complete a 5- to 7-membered ring; m is an integer of from 0 to 4; X represents hydrogen, halogen or may be combined together with Y to represent the atoms necessary to complete a 6-membered aromatic ring, thus forming a fused bicyclic quinoneimine, such as a naphthoquinoneimine; J represents $NHCOR^4$, $NHCO_2R^4$, $NHCONHR^4$, or $NHSO_2R^4$; and with the proviso that when X is combined with Y, then J represents $CONHR^4$, $SO_2NHR^4$, CN, $SO_2R^4$ or SCN, in which case, however, $R^4$ cannot be hydrogen; $R^4$ is the same as $R^1$ or represents an aryl group having from about 6 to about 10 carbon atoms; a heteroaryl group having from about 5 to about 10 atoms; or such aryl or heteroaryl groups substituted with one or more groups for $R^1$ and $R^2$; and Y is the same as $R^4$, or acylamino or may be combined together with X.

Other embodiments include a yellow dye, alone or in combination, comprising at least a first yellow dye of the following Structure X:

(X)

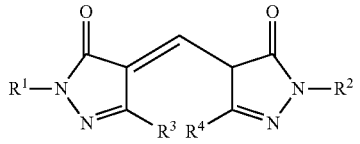

wherein $R^1$ and $R^2$ can be respectively independently selected and are a lower alkyl group which may be substituted, a lower alkenyl group which may be substituted or an aryl group which may be substituted; and $R^3$ and $R^4$ can be respectively independently selected and are a lower alkyl group which may be substituted, a dialkylamino group, a —$COOR^5$ group or a —$CONR^6R^7$ group, in which $R^5$ is a lower alkyl group which may be substituted, a lower alkenyl group which may be substituted or an aryl group which may be substituted and $R^6$ and $R^7$ can be respectively independently selected and are a hydrogen atom, a lower alkyl group which may be substituted, a lower alkenyl group which may be substituted or an aryl group which may be substituted.

A useful yellow dye of Structure X specifically has the following Structure Xa:

(Xa)

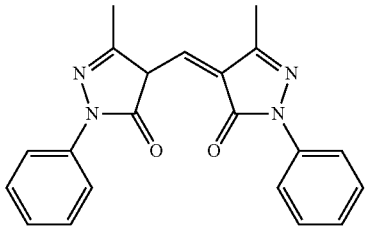

Another embodiment utilizes a yellow dye, alone or in combination, comprising at least a first yellow dye of the following Structure XI:

(XI)

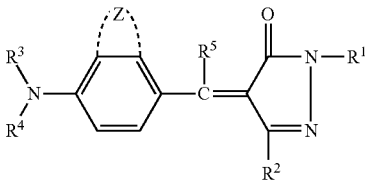

wherein $R^1$ represents a substituted or unsubstituted alkyl group having from 1 to about 10 carbon atoms; a cycloalkyl group having from about 5 to about 7 carbon atoms or an aryl group having from about 6 to about 10 carbon atoms; $R^2$ represents a substituted or unsubstituted alkoxy group having from 1 to about 10 carbon atoms; a substituted or unsubstituted aryloxy group having from about 6 to about 10 carbon atoms; $NHR^6$; $NR^6R^7$ or the atoms necessary to complete a 6-membered ring fused to the benzene ring; $R^3$ and $R^4$ each represents $R^1$; or $R^3$ and $R^4$ can be joined together to form, along with the nitrogen to which they are attached, a 5- or 6-membered heterocyclic ring; $R^5$ represents hydrogen; halogen; carbamoyl; alkoxycarbonyl; acyl; a substituted or unsubstituted alkyl or alkoxy group having from 1 to about 10 carbon atoms; a cycloalkyl group having from about 5 to about 7 carbon atoms; an aryl group having from about 6 to about 10 carbon atoms; or a dialkylamino group; $R^6$ and $R^7$ each independently represents a substituted or unsubstituted alkyl group having from 1 to about 10 carbon atoms; a cycloalkyl group having from about 5 to about 7 carbon atoms or an aryl group having from about 6 to about 10 carbon atoms; $R^6$ and $R^7$ may be joined together to form, along with the nitrogen to which they are attached, a 5- or 6-membered heterocyclic ring; and Z represents hydrogen or the atoms necessary to complete a 5- or 6-membered ring.

A useful yellow dye of Structure XI specifically has the following Structure XIa:

(XIa)

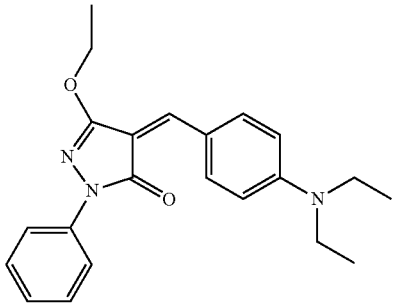

Still other embodiments comprise a yellow dye, alone or in combination, comprising at least a first yellow dye of the following Structure XII:

(XII)

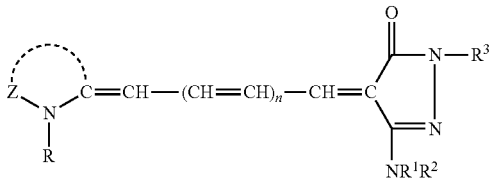

wherein R represents a substituted or unsubstituted alkyl group of from 1 to about 6 carbon atoms or a substituted or unsubstituted aryl group of from about 6 to about 10 carbon atoms; $R^1$ and $R^2$ each independently represents hydrogen, with the proviso that only one of $R^1$ and $R^2$ may be hydrogen at the same time; a substituted or unsubstituted alkyl group of from 1 to about 6 carbon atoms or a substituted or unsubstituted aryl group of from about 6 to about 10 carbon atoms; or $R^1$ and $R^2$ may be combined together with the nitrogen to which they are attached to form a heterocyclic ring system; $R^3$ is R; n represents 0 or 1; and Z represents the atoms necessary to complete a 5- or 6-membered substituted or unsubstituted heterocyclic ring.

A useful yellow dye of Structure XII specifically has the following Structure XIIa:

(XIIa)

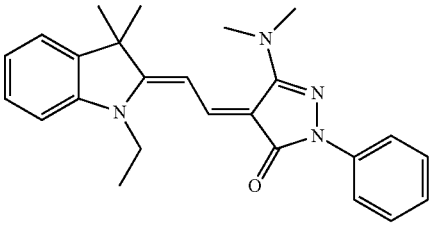

Other suitable yellow dyes can include Phorone Brilliant Yellow S-6 GL (Disperse Yellow 231, manufactured by Sandoz K.K.) and Macrolex Yellow 6G (Disperse Yellow 201, manufactured by Bayer).

Further examples of useful yellow dyes can be found in U.S. Pat. Nos. 4,541,830; 4,698,651; 4,695,287; 4,701,439; 4,757,046; 4,743,582; 4,769,360; 4,753,922; 4,910,187; 5,026,677; 5,101,035; 5,142,089; 5,374,601; 5,476,943; 5,532,202; 5,804,531; 6,265,345; and 6,946,424, the disclosures of which are hereby incorporated by reference.

The dyes can be employed singly or in combination to obtain a monochrome dye donor layer or a black dye donor layer. The dyes can be used in an amount of from about 0.05 $g/m^2$ to about 1 $g/m^2$ of coverage. According to various embodiments, the dyes can be hydrophobic.

Each dye donor layer patch can range from about 20 wt. % to about 90 wt. % dye, relative to the total dry weight of all components in the layer. A high amount of dye is desirable for increased efficiency, but higher amounts of dye can lead to increased occurrences of donor/receiver sticking. Depending on the efficiency of the dye donor layer, a lower amount of dye can be used to achieve the same efficiency as a different dye donor layer. The dye percent is ideally chosen in view of the specific donor element and receiver element combination. Varying the amount of dye in the donor element can aid in matching the efficiency between different dye patches, for example, a cyan, magenta, and yellow patch. For example, yellow or magenta patch dye amounts can be from about 20 to about 75 wt. % dye relative to the total dry weight of all components in the layer, for example, from about 30 to about 50 wt. %. A cyan patch dye amount can be from about 40 to about 90 wt. % dye relative to the total dry weight of all components in the layer, for example, from about 55 to about 75 wt. %.

To form each color patch of a dye donor layer, one or more dyes can be dispersed in a non-heat transferable polymeric binder. Such polymeric binders can be used in an amount of from about 0.05 $g/m^2$ to about 5 $g/m^2$. The polymeric binder can be, for example, a polycarbonate; a polyester; a poly (styrene-co-acrylonitrile); a poly(sulfone); a poly(phenylene oxide); a cellulose derivative such as but not limited to cellulose acetate, cellulose acetate propionate, cellulose acetate butyrate, or cellulose triacetate; or a combination thereof. Typically, the polymeric binder is a cellulose ether or ester, for example, ethyl cellulose.

The dye donor layer can also include beads that can have a particle size of from about 0.5 to about 20 μm, typically from about 2.0 to about 15 μm. The beads can act as spacer beads under the compression force of a wound up dye donor roll, improving raw stock keeping of the dye donor roll by reducing the material transferred from the dye donor layer to the slipping layer, as measured by the change in sensitometry under accelerated aging conditions, or the appearance of unwanted dye in the protective overcoat layer, or from the backside of the dye donor element, for example, a slipping layer, to the dye donor layer. The use of the beads can result in reduced mottle and improved image quality. The beads can be employed in any amount effective for the intended purpose. In general, good results have been obtained at a coverage of from about 0.003 to about 0.20 $g/m^2$. Beads suitable for the dye donor layer can also be used in the slip layer.

The beads in the dye donor layer can be crosslinked, elastomeric beads or they can be hard polymeric beads. Suitable beads can include divinylbenzene beads, beads of polystyrene crosslinked with at least 20 wt. % divinylbenzene, and beads of poly(methyl methacrylate) crosslinked with at least 20 wt. % divinylbenzene, ethylene glycol dimethacrylate, 1,4-cyclohexylene-bis(oxyethyl)dimethacrylate, 1,4-cyclohexylene-bis(oxypropyl)dimethacrylate, or other crosslinking monomers known to those familiar with the art.

Useful elastomeric microbeads have a lower Tg and are compressed under the weight of the thermal print head during printing, thereby allowing better contact between the dye donor and dye receiver elements. When microbeads having a high Tg are used, the microbeads are too rigid and prevent intimate contact between the dye donor and dye receiver during printing, resulting in image mottle and poor image quality. The improved dye donor/dye receiver contact achievable with the low Tg elastomeric microbeads results in reduced mottle and improved image quality. The crosslinked elastomeric beads employed in the invention have a Tg of 45° C. or less, or typically 10° C. or less.

The dye donor element can also include a stick preventative agent to reduce or eliminate sticking between the dye donor element and the dye image-receiver element during printing. The stick preventative agent can be present in any layer of the dye donor element, so long as the stick preventative agent is capable of diffusing through the layers of the dye donor element to the dye donor layer, or transferring from the slip layer to the dye donor layer. For example, the stick preventative agent can be present in one or more patches of the dye donor layer, in the support, in an adhesive layer, in a dye-barrier layer, in a slip layer, or in a combination thereof. According to various embodiments, the stick preventative agent can be in the slip layer, the dye donor layer, or both. According to some embodiments, the stick preventative agent is in the dye donor layer. The stick preventative agent can be in one or more colored patches of the dye donor layer, or a combination thereof. If more than one dye patch is present in the dye donor layer, the stick preventative agent can be present in the last patch of the dye donor layer to be printed, typically the cyan layer. However, the dye patches can be in any order. For example, if repeating patches of cyan, magenta, and yellow are used in the dye donor element, in that respective order, the yellow patches, as the last patches printed in each series, can include the stick preventative agent. The stick preventative agent can be a silicone- or siloxane-containing polymer. Suitable polymers can include graft copolymers, block polymers, copolymers, and polymer blends or mixtures. Suitable stick preventative agents are described, for example, in U.S. Pat. No. 7,067,457 that is incorporated herein by reference.

Release agents as known to practitioners in the art can also be added to the dye donor element, for example, to the dye donor layer, the slip layer, or both. Suitable release agents can include, for example, those described in U.S. Pat. Nos. 4,740,496 and 5,763,358 that are incorporated herein by reference.

The dye donor layer of the heat-transferable dye donor element can be formed or coated on a support. The dye donor layer composition containing dye(s), N-oxyl radical light stabilizer, non-heat transferable binder, and other additives can be dissolved in a solvent for coating purposes. The dye donor layer can be formed or coated on the support by techniques such as, but not limited to, a gravure process, spin-coating, solvent-coating, extrusion-coating, spray-coating, or other methods known to practitioners in the art.

According to various embodiments, a subbing layer, for example, an adhesive or antistatic tie layer, a dye-barrier layer, or a combination thereof, can be coated between the support and the dye donor layer. The subbing layer can comprise one or more layers. Useful subbing layers are described in U.S. Pat. Nos. 4,695,288 and 4,737,486 that are incorporated herein by reference.

The adhesive or tie layer can adhere the dye donor layer to the support. Suitable adhesives are known to practitioners in the art, for example, Tyzor TBT® from E.I. DuPont de Nemours and Company. The dye-barrier layer can include a hydrophilic polymer. The dye-barrier layer can provide improved dye transfer densities.

A dye-barrier layer may be employed in the dye donor elements of the invention to improve the density of the transferred dye. Such dye-barrier layer materials include hydrophilic materials such as those described and claimed in U.S. Pat. No. 4,716,144.

A slipping layer may be used on the back side of the heat transferable dye donor element of the invention to prevent the printing head from sticking to it. Such a slipping layer would comprise either a solid or liquid lubricating material or mixtures thereof, with or without a polymeric binder or a surface-active agent. Useful lubricating materials include oils or semi-crystalline organic solids that melt below 100° C. such as poly(vinyl stearate), beeswax, perfluorinated alkyl ester polyethers, poly-caprolactone, silicone oil, poly(tetrafluoroethylene), carbowax, poly(ethylene glycols), or any of those materials disclosed in U.S. Pat. Nos. 4,717,711; 4,717,712; 4,737,485; and 4,738,950, all incorporated herein by reference. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate, or ethyl cellulose.

For example, the slipping layer formulation most desired for resistive head thermal media incorporates a synergistic combination of lubricants from a friction perspective and in terms of headwear or print head buildup. This slip layer is disclosed in U.S. Pat. No. 7,078,366 that is incorporated herein by reference. Primarily, it includes a dye donor element for thermal dye transfer comprising a support having on one side thereof a dye layer and on the other side a slipping layer comprising a material comprising a maleic anhydride polyethylene graft copolymer and at least one other hydrocarbon wax. There is a dye donor layer on one side of the donor element and on the other side a slipping layer comprising a lubricating material. The lubricating material comprises a solid polymer derived from a polyolefin and an ethylenically unsaturated carboxylic acid or ester or anhydride thereof; and at least one wax. The polymer may be an alpha-olefin maleic anhydride copolymer, a maleic anhydride polyethylene graft copolymer, a copolymer of an α-olefin and isopropyl maleate. The polyolefin is derived from an α-olefin containing between about two to about eight carbon atoms, preferably where the α-olefin is ethylene and/or propylene. The ethylenically unsaturated carboxylic acids are those having between about 3 to about 12 carbon atoms. The ethylenically unsaturated carboxylic acid, ester or anhydride may be, for example, maleic acid, ethylmaleic acid, propylmaleic acid, isopropyl maleic acid, fumaric acid, methylenemalonic acid, glutaconic acid, itaconic acid, methylitaconic acid, mesacomic acid, citraconic acid, or a mixture thereof, as well as corresponding esters, anhydrides or mixtures of such acids, esters and anhydrides. The other wax can be an olefinic wax, a saturated hydrocarbon polymer, a linear low molecular weight polyethylene, a branched hydrocarbon with a number average molecular weight of no more than about 10,000 and a melting point or softening point of no more than about 120° C., or a synthetic wax comprising a saturated or unsaturated hydrocarbon. The other wax may be selected from, for example, a mineral wax, a vegetable wax, an animal wax or a synthetic wax that is a saturated or unsaturated hydrocarbon polymer. The ratio of the first wax to the other wax is 5:1 to 1:10. Typically, the slipping layer comprises at least three different waxes, the polymer derived from the polyolefin and the ethylenically unsaturated carboxylic acid or ester or anhydride thereof, a highly branched α-olefin polymer, and at least one other wax. This slipping layer formulation for resistive head thermal media incorporates a synergistic combination of lubricants from a friction perspective and in terms of head-wear buildup. Additional benefits include preventing or reducing folds, especially when used with relatively fast printers, for example at 4 milliseconds or less per line. A still further benefit is the prevention of retransfer of dye from the dye donor during production. Finally, the slip layer is capable of being coated at high speed.

The amount of lubricating material used in the slip layer is dependent, at least in part, upon the type of lubricating material, but can be in the range of from about 0.001 to about 2 $g/m^2$, although less or more lubricating material can be used as needed. If a polymeric binder is used, the lubricating material can be present in a range of from about 0.1 to about 50 weight %, typically from about 0.5 to about 40 weight %, of the polymeric binder. In one embodiment, the slipping layer comprises from about 10 to about 80 percent by weight of the polymer derived from a polyolefin and an ethylenically unsaturated carboxylic acid or ester or anhydride thereof; from about 10 to about 80 percent by weight of the highly branched α-olefin polymer, and from about 10 to about 80 percent by weight of a substantially linear wax, based on the total weight of the three waxes.

Any binder may also be used in the slipping layer of the invention provided it will be useful for the intended effect. In some embodiments, polymeric thermoplastic binders are employed. Examples of such materials include, for example, poly(styrene-co-acrylonitrile) (70/30 wt. ratio); poly(vinyl alcohol-co-butyral) (available commercially as Butvar® 76® from Monsanto Corp.); poly(vinyl alcohol-co-acetal); poly (vinyl alcohol-co-benzal); polystyrene; poly(vinyl acetate); cellulose acetate butyrate; cellulose acetate propionate; cellulose acetate; ethyl cellulose; cellulose triacetate; poly(methyl methacrylate); and copolymers of methyl methacrylate. In another embodiment, the thermoplastic binder is cellulose acetate propionate or polyvinyl acetal.

The amount of the optional binder employed in the slipping layer may be employed in an amount of from about 0.1 to about 2 $g/m^2$.

The dye image receiving element that is used with the dye donor element of the invention usually comprises a support having thereon a dye image receiving layer. The support for the dye image receiving layer may be transparent or reflective. The support may be a transparent film such as a poly (ether sulfone), a polyimide, a cellulose ester such as cellulose acetate, a poly(vinyl alcohol-co-acetal) or a poly (ethylene terephthalate). Opaque, reflective supports can include plain paper, coated paper, synthetic paper, photographic paper support, melt-extrusion-coated paper, and laminated paper, such as biaxially oriented support laminates. Biaxially oriented support laminates suitable for use as receivers are described in U.S. Pat. Nos. 5,853,965; 5,866,282; 5,874,205; 5,888,643; 5,888,681; 5,888,683; and 5,888,714, all incorporated herein by reference. Biaxially oriented supports can include a paper base and a biaxially oriented polyolefin sheet, for example, polypropylene, laminated to one or both sides of the paper base. The support can be a reflective paper, for example, baryta-coated paper, white polyester (polyester with white pigment incorporated therein), an ivory paper, a condenser paper, or a synthetic paper, for example, DuPont Tyvek® by E.I. DuPont de Nemours and Company (Wilmington, Del.). The support can be employed at any desired thickness, for example, from about 10 μm to about 1000 μm. Exemplary supports for the dye image-receiving layer are disclosed in commonly assigned U.S. Pat. Nos. 5,244,861 and 5,928,990 and EP 671,281, all incorporated herein by reference. Other suitable supports as known to practitioners in the art can also be used. According to various embodiments, the support can be a composite or laminate structure comprising a base layer and one or more additional layers. The base layer can comprise more than one material, for example, a combination of one or more of a microvoided layer, a foamed layer, a layer with hollow particles, a nonvoided layer, a synthetic paper, a natural paper, and a polymer. The dye image-receiving layer may comprise, for example, a polycarbonate, a polyurethane, a polyester, poly(styrene-co-acrylonitrile), polycaprolactone, vinyl-series resins, such as halogenated polymers (for example, polyvinyl chloride and polyvinylidene chloride), poly(vinyl acetate), ethylene-vinyl acetate copolymer, vinyl chloride-vinyl acetate copolymer, or mixtures thereof. Latex polymers may be used in the dye image-receiving layer. The latex polymer may be a dispersion in which hydrophobic polymers comprising a monomer unit of, for example, water-insoluble vinyl chloride dispersed as fine particles in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure, or the like. For such latex polymers it is desirable to prepare the dye image-receiving layer by applying an aqueous type coating solution and then drying it. Exemplary aqueous coating formats are disclosed in U.S. Patent Application Publication 2008/0254241. The dye image-receiving layer may be present in any amount that is effective for the intended purpose. In general, good results have been obtained at a concentration of from about 1 to about 5 $g/m^2$. Details of useful polymers and supports for the dye image-receiving element are provided for example in U.S. Pat. No. 7,514,028 (Kung et al.) that is incorporated herein by reference.

The dye image-receiving layer generally includes one or more plasticizers in an amount of up to about 100 weight % based on total layer polymer weight. Generally, the amount of plasticizer is from about 4 to about 30% based on the total polymer weight. Useful plasticizers include but are not limited to, aliphatic esters such as monomeric and polymeric esters such as ditridecyl phthalate, dicyclohexyl phthalate, dioctylsebacate, polycaprolactone, poly(butylene adipate), and poly(hexamethylene sebacate), as well as others described in U.S. Pat. Nos. 4,871,715 (Harrison et al.) and 6,291,396 (Bodem et al.).

Other optional additives the dye image-receiving layer include stabilizers such as phosphorus-containing stabilizers (for example, phosphorous acid, an organic diphosphite, a phosphate, an alkyl phosphate, an aryl phosphate, an inorganic phosphate, a phosphoric acid ester, or a phosphorous acid ester) and dialkyl esters (such as dioctyl sebacate) or combinations thereof, release agents such as a modified polydimethylsiloxane, and α-tocophenol or derivatives thereof, as described for example in U.S. Pat. No. 7,514,028 (noted above). Other release agents include silicone or fluorine based compounds as disclosed, for example, in U.S. Pat. Nos. 4,820,687 and 4,695,286, the disclosures of which are incorporated herein by reference.

Additional polymeric layers can be present between the support and the dye image-receiving layer. The additional layers can provide coloring, adhesion, antistatic properties, act as a dye-barrier, act as a dye mordant layer, or a combination thereof. For example, a polyolefin such as polyethylene or polypropylene can be present. White pigments such as titanium dioxide, zinc oxide, and the like can be added to the polymeric layer to provide reflectivity.

A subbing layer can be used over the polymeric layer in order to improve adhesion to the dye image-receiving layer. This can be called an adhesive or tie layer. Exemplary subbing layers are disclosed in U.S. Pat. Nos. 4,748,150, 4,965,238, 4,965,239, and 4,965,241 that are incorporated herein by reference. An antistatic layer as known to practitioners in the art can also be used in the receiver element. The receiver element can also include a backing layer. Suitable examples of backing layers include those disclosed in U.S. Pat. Nos. 5,011,814 and 5,096,875 that are incorporated herein by reference.

The dye image-receiver element can also include stick preventative agents, as described for the heat transferable dye donor element. The dye image-receiver element and dye donor element can include the same stick preventative agent.

The dye image-receiving layer can be formed on the support by any method known to practitioners in the art, including but not limited to printing, solution coating, dip coating, and extrusion coating. When the dye image-receiving layer is extruded, the process can include (a) forming a melt comprising a thermoplastic material; (b) extruding or coextruding the melt as a single-layer film or a layer of a composite (multilayer or laminate) film; and (c) applying the extruded film to the support for the receiver element. Exemplary extruded receiving layer formats are disclosed in U.S. Pat. Nos. 7,125,611, 7,091,157, 7,005,406, 6,893,592, and 6,897,183, the disclosures of which are incorporated by reference.

Thermal printing heads, which can be used to transfer dye from the dye donor elements of the invention, are available commercially. Representative examples include, for example, a Fujitsu Thermal Head FTP-040 MCSOO1, a TDK Thermal Head LV5416, or a Rohm Thermal Head KE 2008-F3.

A thermal dye transfer assemblage of the invention comprises (a) a heat transferable dye donor element of this invention as described above, and (b) a dye image-receiving element as described above, the dye image-receiving element being in a superposed relationship with the heat transferable dye donor element so that the dye layer of that donor element is in contact with the dye image-receiving layer of the dye-image receiving element.

The assemblage comprising these two elements may be pre-assembled as an integral unit when a monochrome image is to be obtained. This may be done by temporarily adhering the two elements together at their margins. After transfer, the dye image-receiving element is then peeled apart to reveal the transferred dye image.

When a three-color image is to be obtained, the assemblage is formed on three occasions during the time when heat is applied by the thermal printing head. After the first dye is transferred, the elements are peeled apart. A second dye donor element (or another area of the donor element with a different dye area) is then brought in register with the dye image-receiving element and the process is repeated. The third color is obtained in the same manner. Finally, a protective overcoat material is usually applied on top.

When a protective overcoat material is applied, it can be patterned to provide a matte or glossy finish by varying thickness, line time, print energy, or some combination thereof. Further, expandable or pre-expanded beads can be used in a laminate or protective overcoat layer to affect a gloss or matte finish depending on the amount and size of the beads. Overcoats, whether patterned or not, can be provided on any colorant containing material, for example but not limited to, printed ink jet, thermal, or electrophotographic receivers, or silver halide prints.

The following embodiments represent some of those provided by this invention:

1: A heat transferable dye donor element comprising a polymeric support, the support having at least one portion thereof coated with a heat transferable material comprising a heat transferable dye and an N-oxyl radical light stabilizer that is derived from a hindered amine, the N-oxyl radical having the following formula:

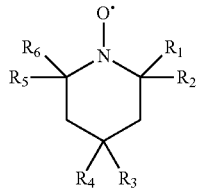

wherein $R_1$, $R_2$, $R_5$, and $R_6$ are each independently selected from a straight or branched $C_1$-$C_6$ alkyl or alkene, and $R_3$ and $R_4$ are each independently selected from H, OH, OR, COOH, or COOR, wherein R is a straight or branched $C_1$-$C_6$ alkyl or alkene, and having a molecular weight of 600 or less.

2: The element of embodiment 1 comprising at least one dye donor patch and optionally at least one protective overcoat patch.

3: The element of embodiment 1 or 2 wherein the N-oxyl radical light stabilizer is:

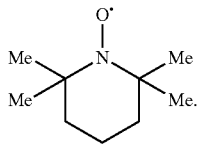

4: The element of any of embodiments 1 to 3 wherein the heat transferable material further comprises a plasticizer in the amount of from 0 to 2% by weight.

5: The element of any of embodiments 1 to 4 wherein the heat transferable material comprises at least one non-heat transferable polymer binder.

6: The element of any of embodiments 1 to 5 wherein the N-oxyl radical light stabilizer is present in the heat transferable material in an amount of from about 1.08 to about 32.4 $mg/m^2$.

7: The element of any of embodiments 1 to 6 comprising multiple dye patches comprising the heat transferable material having different heat transferable dyes including at least one dye patch having a cyan dye and in which the amount of the N-oxyl radical light stabilizer in the cyan dye patch is higher than the amount of the N-oxyl radical light stabilizer in any other dye patch.

8: A method of coating a dye image-receiver material with a dye comprising:

contacting the heat transferable dye donor element of any of embodiments 1 to 7 with a dye image-receiver element, and applying heat or pressure sufficient to transfer at least one dye from the heat transferable dye donor element to the dye image-receiver element.

9: The method of embodiment 8 wherein the dye image-receiver element is a thermal dye image-receiver element.

10: The method of embodiment 8 or 9 wherein the dye image-receiver element comprises a dye image-receiving layer comprising a plasticizer in an amount of at least 4 weight % based on the total polymer weight of the dye image-receiving layer.

11: A thermal transfer assemblage comprising a dye image-receiver element in contact with at least a portion of the heat transferable dye donor element of any of embodiments 1 to 7.

12: The assemblage of any of embodiment 11 wherein the heat transferable dye donor element comprises two or more patches of heat transferable material, wherein at least one patch includes a heat transferable dye.

EXAMPLES

The following examples are provided to illustrate the invention but the invention is not to be limited to these embodiments.

Receiving Element:

Thermal Receiver R-1 was used having an overall thickness of about 220 μm and a thermal dye receiving layer thickness of about 3 μm. R-1 was prepared by melt extruding the tie layer and dye receiving layer onto the paper support, resulting in the following structure:

| |
|---|
| Co-extruded polyester-polycarbonate-silicone dye receiving layer |
| PELESTAT ® 300 (Sanyo Chemical Industries, Ltd.) tie layer |
| Microvoided composite film OPPalyte ® 350 K18 (ExxonMobil) |
| Pigmented polyethylene |
| Cellulose Paper |
| Polyethylene |
| Polypropylene film |

KODAK Professional EKTATHERM ribbon, catalogue #106-7347, was used in a KODAK Thermal Photo Printer, model number 6850, with receiver R-1 to produce multiple, identical test target prints whose records were composed of neutral, monochrome, and bi-chromes consisting of two colors. Each record was arranged in a 15 step incremental density change from minimum density (Dmin) to maximum density (Dmax). The protective overcoat patch on the donor ribbon was then transferred onto a test target print. The protective overcoat was laminated with a transfer line-time of 0.8 ms.

Light Fade Test Method:

Test target Status A densities were measured using an X-Rite Transmission/Reflection Densitometer model 820 from X-Rite Inc. The test targets were subjected to 50 Klux high intensity daylight using a xenon light source at room temperature for 28 days. Test target dye densities were read at 1.0 and Delta density changes from start densities were calculated and reported as Delta density. A lower absolute number indicates less change from the original sample, and therefore a better result (for example, −0.20 is better than −0.40, having less color change). A difference of at least 0.02 is considered significant and it is desired that the Delta difference be as close to 0 as possible.

Control Thermal Dye Donor Element C-1:

KODAK Professional EKTATHERM ribbon, catalogue #106-7347, was used in a KODAK Thermal Photo Printer, model number 6850. This thermal ribbon contains cyan Dyes A, B, and C shown below.

The protective overcoat of the donor elements were prepared by coating on the back side of a 4.5 μm poly(ethylene terephthalate) support:

1) a subbing layer of titanium alkoxide, Tyzor TBT®, (DuPont Corp.) (0.13 g/m$^2$) from a n-propyl acetate and n-butyl alcohol solvent mixture (85/15), and 2) a slipping layer containing 0.02 g/m$^2$ Polywax® 400, 0.02 g/m$^2$ Vybar® 103, 0.02 g/m$^2$ Ceramer 1608, all from Baker-Petrolite Corp., and 0.38 g/m$^2$ poly(vinyl acetal) binder KS-1 from Sekisui Co, coated from a 75/20/5 solvent mixture of toluene, methanol, and cyclopentanone.

A transferable protective overcoat layer of poly(vinyl acetal) KS-10 at a laydown of 0.63 g/m$^2$, IPA-ST (Nippon) at a laydown of 0.46 g/m$^2$, and UV Absorber TINUVIN® 460 (Ciba Specialties Co.), was coated on the front side of the dye donor element at a laydown of 0.11 g/m$^2$, and contained 4 μm poly(divinylbenzene) beads at a laydown of 0.03 g/m$^2$. The materials were coated from solvent 3-pentanone.

Invention Example 1

Stabilized Cyan Dye Patch

A thermal dye donor element of this invention was prepared like the Control Donor Element C-1 except that its front side was prepared in the following manner, using the same coverage of dye as present in the cyan dye patch of the Ektatherm ribbon in Control Element C-1.

To a magnetically stirred 16 oz. clear jar with threaded cap containing 192 g toluene and 51 g methanol was added 13.08 g of CAP-482-20 (a cellulose acetate propionate from Eastman Chemicals Co.). The mixture was stirred at room temperature until solution was obtained. Then, 5.4 g of Dye A (0.087 g/m$^2$), 4.9 g of Dye B (0.079 g/m$^2$), 12.26 g of Dye C (0.198 g/m$^2$), 3.33 g of TEMPO light stabilizer (0.0538 g/m$^2$), 1.05 g of Paraplex® G25 plasticizer available from Hallstar (0.0170 g/m$^2$), 0.06 g of Silwet® L7230 (0.001 g/m$^2$) were added in succession, followed by adding 0.52 g of 2 μm poly(divinylbenzene) beads (0.008 g/m$^2$), and the mixture was stirred at room temperature for 24 hours.

Dye A

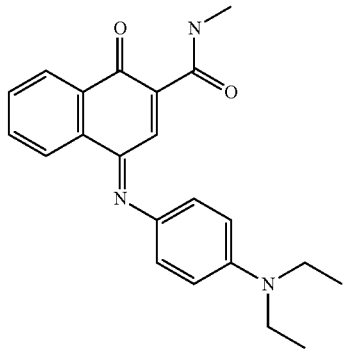

Dye B

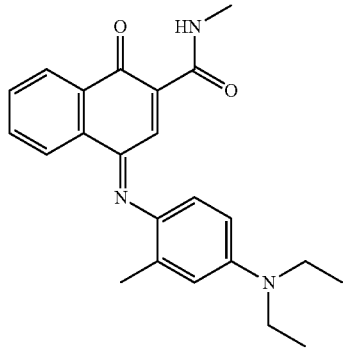

-continued

Dye C

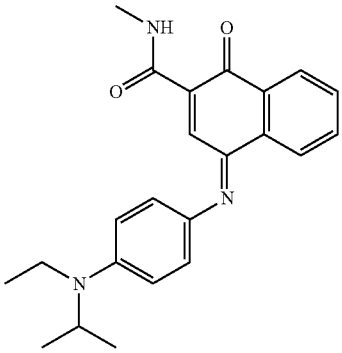

Light fade testing results are shown in TABLE I.

TABLE I

| Donor Element | TEMPO ($g/m^2$) | Tinuvin ® 460 ($g/m^2$) | Delta Red of Blue | Delta Red of Neutral |
|---|---|---|---|---|
| Control C-1 | 0 | 0.090 | −0.23 | −0.19 |
| Invention Example 1 | 0.054 | 0.090 | −0.14 | −0.12 |

The presence of the N-oxyl radical light stabilizer in the cyan dye patch of the Invention thermal dye donor element produced a significant improvement in light stability as shown by the difference in the "Delta" data compared to the Control C-1 thermal dye donor element that lacked the N-oxyl radical light stabilizer but contained a different light stabilizer in the overcoat only.

Invention Example 2

Stabilized Cyan Dye Patch

A similar thermal dye donor element of this invention was prepared like that in Invention Example 1 and compared to another Control C-2 element like Control C-1 element having a UV light stabilizer in the overcoat only. The light fading results are shown in the following TABLES II and III, where the data show that the presence of the N-oxyl radical as a light stabilizer in the cyan dye patch provided improved light stability compared the Control C-2 element having the UV light absorber Tinuvin® 460 in the overcoat only.

TABLE II

| Donor Element | TEMPO ($g/m^2$) | Tinuvin ® 460 ($g/m^2$) | Delta Green of Neutral | Delta Blue of Neutral |
|---|---|---|---|---|
| Control C-2 | 0 | 0.090 | −0.17 | −0.17 |
| Invention Example 2 | 0.054 | 0.090 | −0.10 | −0.07 |

TABLE III

| Donor Element | TEMPO ($g/m^2$) | Tinuvin ® 460 ($g/m^2$) | Delta Blue of Green | Delta Green of Blue |
|---|---|---|---|---|
| Control C-2 | 0 | 0.090 | −0.21 | −0.19 |
| Invention Example 2 | 0.054 | 0.090 | −0.09 | −0.12 |

Invention Example 3

Stabilized Cyan Dye Patch

Invention Example 1 was followed except that the densities were measured at 0.5 instead of 1.0. The results are shown below in TABLE IV in which the data show an improvement for the present invention although the improvement is not as great as seen at a Density of 1.0 in every color space.

TABLE IV

| Donor Element | TEMPO ($g/m^2$) | Tinuvin ® 460 ($g/m^2$) | Delta Red of Neutral | Delta Green of Neutral | Delta Blue of Neutral |
|---|---|---|---|---|---|
| Control C-3 | 0 | 0.090 | −0.24 | −0.16 | −0.17 |
| Invention Example 3 | 0.054 | 0.090 | −0.19 | −0.16 | −0.11 |

Invention Examples 4-6

Stabilized Yellow Dye Patch

Three thermal dye donor elements of this invention were similarly prepared like the Control Donor Element C-1 except that their front side was prepared in the following manner, using the same coverage of dye as present in the yellow dye patch of the Ektatherm ribbon in Control Element C-1.

To a magnetically stirred 16 oz. (473 ml) clear jar having a threaded cap containing 205.39 g of toluene, 54.7 g of methanol, and 13.7 g of cyclopentanone were added 7.50 g of Ethocel 200 (Hercules Corp.). The resulting mixture was stirred at room temperature until a solution was obtained. Then, 9.60 g of Dye A, 4.19 g of Dye B, 4.17 g of TEMPO light stabilizer were added in succession, followed by adding 0.74 g of 2 μm poly(divinylbenzene) beads, and the mixture was stirred at room temperature for 24 hours.

Dye D

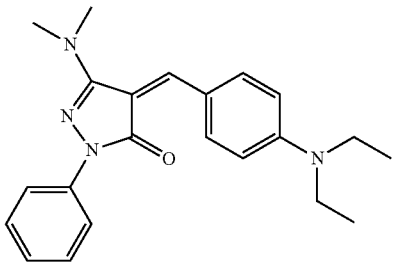

Dye E

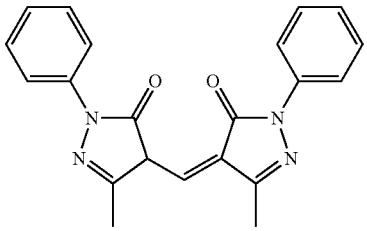

Light fade testing results were measured at Density 0.5 and are shown in the following TABLES V-VII.

TABLE V

| Donor Element | TEMPO ($g/m^2$) | Tinuvin ® 460 ($g/m^2$) | Delta Blue of Neutral |
|---|---|---|---|
| Control C-1 | 0 | 0.090 | −0.17 |
| Invention Example 4 | 0.054 | 0.090 | −0.14 |

TABLE VI

| Donor Element | TEMPO ($g/m^2$) | Tinuvin ® 460 ($g/m^2$) | Delta Yellow |
|---|---|---|---|
| Control C-1 | 0 | 0.090 | −0.07 |
| Invention Example 5 | 0.054 | 0.090 | −0.05 |

TABLE VII

| Donor Element | TEMPO ($g/m^2$) | Tinuvin ® 460 ($g/m^2$) | Delta Blue of Red | Delta Green of Blue |
|---|---|---|---|---|
| Control C-2 | 0 | 0.090 | −0.19 | −0.13 |
| Invention Example 6 | 0.054 | 0.090 | −0.14 | −0.11 |

Invention Example 7

Stabilized Cyan Dye Patch

Invention Example 1 was followed except that the densities were measured at 1.5 instead of 1.0. The results are shown below in TABLES VIII and IX in which the data show an improvement for the present invention.

TABLE VIII

| Donor Element | TEMPO ($g/m^2$) | Tinuvin ® 460 ($g/m^2$) | Delta Green of Neutral | Delta Blue of Neutral |
|---|---|---|---|---|
| Control C-1 | 0 | 0.090 | −0.16 | −0.14 |
| Invention Example 7 | 0.054 | 0.090 | −0.11 | −0.07 |

TABLE IX

| Donor Element | TEMPO ($g/m^2$) | Tinuvin ® 460 ($g/m^2$) | Delta Blue of Green | Delta Green of Blue |
|---|---|---|---|---|
| Control C-1 | 0 | 0.090 | −0.16 | −0.18 |
| Invention Example 7 | 0.054 | 0.090 | −0.10 | −0.12 |

The invention has been described in detail with particular reference to certain preferred embodiments thereof, but it will be understood that variations and modifications can be effected within the spirit and scope of the invention.

The invention claimed is:

1. A heat transferable dye donor element comprising a polymeric support, the support having at least one portion thereof coated with a heat transferable material comprising a heat transferable dye, a plasticizer in an amount of up to 5 weight %, and from about 1.08 to about 32.4 $mg/m^2$ of an N-oxyl radical light stabilizer having the following formula:

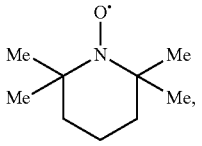

wherein the heat transferable dye donor element comprises multiple dye patches comprising the heat transferable material having different heat transferable dyes including at least one dye patch having a cyan dye and in which the amount of the N-oxyl radical light stabilizer in the cyan dye patch is higher than the amount of the N-oxyl radical light stabilizer in any other dye patch.

2. The element of claim 1 comprising at least one dye donor patch, and optionally at least one protective overcoat patch.

3. The element of claim 1 wherein the heat transferable material further comprises a plasticizer in the amount of up to 2% by weight.

4. The element of claim 1 wherein the heat transferable material further comprises at least one non-heat transferable polymeric binder.

5. A thermal dye transfer assemblage comprising a dye image-receiver element in contact with at least a portion of a heat transfer dye donor element, wherein the donor element comprises a polymeric support having at least one portion thereof coated with a heat transferable material comprising a heat transferable dye, a plasticizer in an amount of up to 5 weight %, and from about 1.08 to about 32.4 $mg/m^2$ of an N-oxyl radical light stabilizer having the following formula:

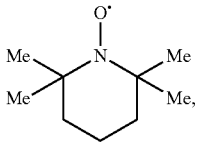

wherein the heat transferable dye donor element comprises multiple dye patches comprising the heat transferable material having different heat transferable dyes including at least one dye patch having a cyan dye and in which the amount of the N-oxyl radical light stabilizer in the cyan dye patch is higher than the amount of the N-oxyl radical light stabilizer in any other dye patch.

6. The assemblage of claim 5 wherein the heat transferable material of the dye donor element further comprises at least one non-heat transferable polymeric binder.

7. The assemblage of claim 5 wherein the dye donor element comprises two or more patches of heat transferable material, wherein at least one patch includes a heat transferable dye.

8. The assemblage of claim 5 wherein the dye image-receiver element is a thermal dye image-receiver element having a dye image-receiving layer comprising the plasticizer in an amount of at least 4 weight % based on total polymer weight in the dye image-receiving layer.

9. The element of claim 1 further comprising a protective overcoat patch, and wherein the amount of the N-oxyl radical light stabilizer in the cyan dye patch is up to twice as much as the N-oxyl radical light stabilizer in a protective overcoat layer.

* * * * *